United States Patent [19]

Risley

[11] Patent Number: 4,947,591

[45] Date of Patent: Aug. 14, 1990

[54] DRY PAINT STRIPPING METHOD

[75] Inventor: Lon F. Risley, Banning, Calif.

[73] Assignee: Avonite, Inc., Belen, N. Mex.

[21] Appl. No.: 462,191

[22] Filed: Jan. 9, 1990

[51] Int. Cl.[5] ..... B24B 1/00

[52] U.S. Cl. ..... 51/320; 51/317; 51/298; 134/17

[58] Field of Search ..... 51/320, 319, 298; 134/17

[56] References Cited

U.S. PATENT DOCUMENTS 4,731,125 3/1988 Carr ..... 51/320

OTHER PUBLICATIONS

Military Specification, "Plastic Media, for Removal of Organic Coatings", MIL-P-85891(AS), 6 May 1988.

*Primary Examiner*—Frederick R. Schmidt
*Assistant Examiner*—Maurina Rachuba
*Attorney, Agent, or Firm*—William L. Krayer

[57] ABSTRACT

Paint is removed from surfaces by impacting it with particles of cured unsaturated polyester including about 10–20 weight weight percent methyl methacrylate, the particles having a low ratio of longest to shortest dimension and an average of at least about 40 facets.

9 Claims, 1 Drawing Sheet

DRY PAINT STRIPPING METHOD

TECHNICAL FIELD

This invention relates to a method of removing paint from a painted surface by striking the surface with small abrasive particles. The particles used are of a more or less conventional unsaturated polyester composition containing about 10 to about 20 percent by weight of an acrylic ester and have preferably been ground from a polymerized mass and further broken by impact to achieve an average particle size of about 20–60 mesh (will pass through a sieve of 850 microns and be retained on a sieve of 180 microns), a Barcol hardness of about 46 to about 54 and a specific gravity of about 1.1 to about 1.3. Such particles are effective in removing the paint but will cause very little damage to a metallic surface such as an airplane or truck body.

BACKGROUND OF THE INVENTION

Prior to the present invention it has long been known to sandblast paint from painted surfaces, using various types of particles, sand, or grit. The particles have been relatively dense and hard where damage to the painted surface is not an important factor. The present invention is concerned primarily with processes which will cause little damage to a metallic surface such as an airplane or a truck body, or a non-metallic surface as a circuit board.

Military and non-military specifications have been written for particles to be used (in an air-blast gun), calling for a specific gravity of about 1.2 and a Barcol hardness of 46–54, roughly equivalent to a Rockwell hardness of about 3.5. The performance specification for such particles calls for paint removal (stripping a coating of paint about 1.7 to 2.3 mils and an epoxy primer about 0.6–0.9 mil) at a rate of at least 0.15 $ft.^2$/min. using an air-blaster capable of impelling the particles at a rate of 2.3–2.8 lbs. per second with 30 psi. See MIL-P-85891(AS), May 6, 1988, Military Specification, "Plastic Media, for Removal of Organic Coatings". Such methods of paint removal are far more acceptable environmentally than any method employing solvents. However, the particles heretofore used have either damaged the surfaces unacceptably or have not been capable of recycling because they break on impact with the painted surface; a number of polymeric particles tried have either been unable to meet the removal rate specification or, apparently because of brittleness, have become too fine for recycling through attrition. Removal rate is a function, among other variables, of the number of edges on a given particle. Polyester and other particles used in the prior art have frequently exhibited a shape with predominant flat surfaces, i.e., more or less as a flake, so that there are relatively few working edges available to strike the paint.

Both unsaturated polyesters and polymethylmethacrylate have been proposed for paint removal by blasting. See Military Specification MIL-P-85891(AS), May 6, 1988. To my knowledge, however, the particular compositions I use have not been used or suggested, and the improved results I obtain have not been seen in the past.

SUMMARY OF THE INVENTION

I have discovered an improvement in the art of grit blasting which has the advantage of much greater recyclability, an excellent removal rate, and very little damage to the painted surface. My invention involves the use of a particular polyester/acrylic composition, preferably crushed and broken in a particular way as described herein.

Compositions having the following ingredients and cured into a mass can be crushed and/or ground to obtain particles which have not only the appropriate hardness and density, but also an optimum or near-optimum number of working edges or facets per unit of weight or particle. The polyester/acrylic compositions include about 30–40 weight percent of a polyol such as propylene glycol, about 40–45 weight percent maleic anhydride, about 5–20 percent styrene, and about 10 to about 20 percent by weight methyl methacrylate. Small amounts of additives such as Cyanostat CN, methyl cellulose, polyester pigment, zinc octoate, and butyl trimethyl ammonium chloride may also be optionally included for purposes known to those skilled in the polymer art.

Such a composition may be cured and/or polymerized as is known in the art with a peroxide or other catalyst selected from cumene hydroperoxide and dibenzoyl peroxide. When the mass is hardened or cured, it is crushed or ground in any convenient manner to achieve an average particle size of about 250 microns to about 850 microns and a particle size distribution of about 20 to about 60 mesh. If the cure is conducted at 180° F., the particles will have densities of about 1.1 to about 1.3 (preferably about 1.18 to about 1.2) and Barcol hardness of about 45 to about 55, which are suitable for grit-blast operations. Preferably, the breaking of the mass is conducted in two steps—first, the mass is crushed in a rapid grind shredder to a particle size of about 3 mm to about 4 mm and then these particles are placed in a centrifugal impact mill to be broken against a hard surface at a velocity of about 19,000 ft./min. to about 21,000 ft./min. It is believed the impacting step is particularly useful for making blasting grit because the procedure tends to fracture the particles at their weakest points, and accordingly a relatively strong particle remains. Moreover, the fractures are such that the particles tend to have a relatively low ratio of their longest dimensions to their shortest, i.e., about 1 to about 1.3, as compared to prior art polyester particles whose similar ratio may be about 2 to about 1. Such a ratio may be considered to be an indication of the number of working edges of the particles. It is believed that particles with relatively flat or flaky shapes are not as effective as those which are deeper and have more working edges of perhaps shorter length because the flatter ones are more likely to strike in such a manner that the particle's center of gravity is at a greater angle from the point of initial contact. My particles, tending to have fewer surfaces of a large area, are more likely to impart the maximum force at the initial point of impact; at the same time, the edges are generally not as sharp as the flatter particles and accordingly provide no more penetration than is necessary to remove the paint.

DETAILED DESCRIPTION OF THE INVENTION

My invention will be described in more detail below, in reference to the drawings and the experimental data presented.

Figure 1:
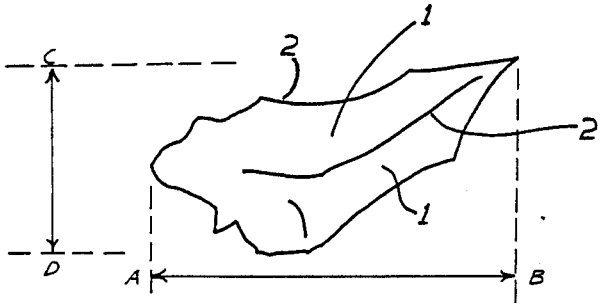
FIG. 1 PRIOR ART
Figure 2:
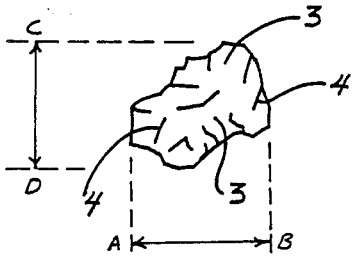

FIGS. 1 and 2 are more or less idealized representations of typical prior art particles and those of the present invention.

It will be seen from FIG. 1 that the prior art particles of conventional polyester tend to have relatively large flat areas or facets 1 and relatively acute angular edges 2. I have determined that a rough measure of such facet size and edge angularity may be obtained by dividing the longest dimension A-B by the shortest dimension C-D in each case. Prior art particles I have seen have such a ratio of at least 2. Generally, by microscope, I have estimated these ratios in my particles to be about 1.0 to about 1.3. In FIG. 2, which depicts a typical particle of my invention, it will be seen that the shape is decidedly different from that of FIG. 1; in particular the flat areas 3 are relatively small and there are generally more edges 4, which tend to be less acute than those of FIG. 1. The ratio of the longest to shortest dimensions (A-B/C-D) tends to be a significantly lower number than that of FIG. 1. A preferred batch of particles of my invention will have an average number of facets of at least about 40, generally about 40 to about 60.

In a test of particles of my invention under similar conditions (air pressure, velocity, and quantity delivered per unit of time), the particles of my invention removed paint at an average rate of 2.0 square feet per minute, compared to about 0.8 square feet per minute for a conventional particle not including an acrylate as a monomer and not having a shape (ratio of longest dimension to shortest) in the range from 1 to 1.3.

The consumption rate, calculated according to paragraph 4.5.12.3 of Military Specification MIL-P-85891(AS) 6 May 1988 was 94% following the above-identified procedure; while the procedure calls for a result in terms of "consumption", it is actually expressed as a percentage of material recycled after four cycles. This result was based on the average of three tests. Seven percent loss is the maximum allowed for this type of medium for the four cycle minimum.

I claim:

1. Method of removing paint from a painted structure comprising impacting said painted structure with particles of a acrylic-containing unsaturated polyester, said acrylic-containing unsaturated polyester comprising a polymerized composition of about 30 to about 40 wt % polyol, about 40 to about 45 wt % maleic anhydride, about 10 to about 20 wt % methyl methacrylate and about 5–20% styrene.

2. Method of claim 1 wherein the particles of acrylic-containing polyester have an average particle size of about 250 microns to about 850 microns, a particle size distribution of about 20 to about 60 mesh, an average ratio of longest dimension to shortest dimension of about 1:1 to about 1.3:1, and a specific gravity of about 1.1 to about 1.3.

3. Method of claim 1 wherein said particles are ground from a cured mass of said acrylic-containing polyester to impart an average of at least about 40 facets on said particles.

4. Method of claim 1 wherein said particles are impacted at a velocity of about 140 lbs./hr. to about 170 lbs./hr.

5. Method of claim 1 including the steps of recovering at least about 50% of said particles after impacting said painted structure, and again impacting a painted structure with said particles.

6. Method of claim 5 including the step of separating paint residue from said particles while recovering said particles.

7. Method of claim 1 wherein said particles have a Barcol hardness of about 46 to about 56.

8. A ground cured mass of acrylic-containing unsaturated polyester particles comprising a polymerized composition of about 30 to about 40% by weight polyol, about 40 to about 45 percent by weight maleic anhydride, about 10 to about 20 percent by weight methyl methacrylate and about 5–20% by weight styrene, said particles having an average ratio of longest dimension to shortest dimension of about 1:1 to about 1.3:1 and having an average of at least about 40 facets.

9. Cured particles of claim 8 having a specific gravity of about 1.1 to about 1.3.

* * * * *